United States Patent [19]

Bryner

[11] 4,359,840

[45] Nov. 23, 1982

[54] AUTOMATIC GRINDING APPARATUS TO CONTROL UNIFORM SPECIMEN THICKNESSES

[75] Inventor: Joseph S. Bryner, Pittsburgh, Pa.

[73] Assignee: The United States of America as represented by the United States Department of Energy, Washington, D.C.

[21] Appl. No.: 222,868

[22] Filed: Jan. 7, 1981

[51] Int. Cl.[3] ..... B24B 7/22

[52] U.S. Cl. ..... 51/131.4; 51/216 R; 51/237 R

[58] Field of Search ..... 51/131.3, 131.4, 131.5, 51/134, 236, 237 R, 216 R

[56] References Cited

U.S. PATENT DOCUMENTS

| | | | |
|---|---|---|---|
| 2,668,397 | 2/1954 | Holzrichter et al. . | |
| 2,967,380 | 1/1961 | Damgaard | 51/236 |
| 2,983,086 | 5/1961 | La Chapelle, Jr. . | |
| 3,388,506 | 6/1968 | Boettcher . | |
| 3,505,761 | 4/1970 | Boettcher | 51/236 |
| 3,813,828 | 6/1974 | Bennett . | |
| 3,892,092 | 7/1975 | Keith . | |
| 4,020,600 | 5/1977 | Day | 51/131.4 |

FOREIGN PATENT DOCUMENTS

| | | | |
|---|---|---|---|
| 674877 | 7/1979 | U.S.S.R. | 51/131.4 |

*Primary Examiner*—Harold D. Whitehead

*Attorney, Agent, or Firm*—Michael F. Esposito; Richard G. Besha; James E. Denny

[57] ABSTRACT

This invention is directed to a new and improved grinding apparatus comprising (1) a movable grinding surface, (2) a specimen holder, (3) a displacing device for moving the holder and/or grinding surface toward one another, and (4) at least three devices for limiting displacement of the holder to the grinding surface.

5 Claims, 2 Drawing Figures

AUTOMATIC GRINDING APPARATUS TO CONTROL UNIFORM SPECIMEN THICKNESSES

The U.S. Government has rights in this invention pursuant to Contract No. E(36-1)-Gen-14 between the Department of Energy and Westinghouse Electric Corporation.

BACKGROUND OF THE INVENTION

This invention relates to a new and improved apparatus for grinding bulk specimens to remove surface irregularities and subsurface distortions. In particular, this invention relates to a new and improved grinding apparatus for use in the preparation of bulk metal specimens for electron-transmission microscopy.

The preparation of metal specimens for electron-transmission microscopy from bulk metal specimens ordinarily includes cutting thin slices from the bulk specimen, and grinding the slices to remove surface irregularities and subsurface distortions. The ground slices or platelets are subsequently thinned to electron transparency by chemical or electrolytic dissolution. The grinding process must be relatively gentle to minimize the depth of surface deformation and to avoid heating of the specimens. In addition, the grinding procedure should produce platelet specimens possessing substantially flat, parallel surfaces of uniform thicknesses of about 0.010 inch. These ground platelets facilitate the production of deformation-free foils by chemical or electrolytic dissolution. The production of satisfactory platelets by hand grinding is a slow process requiring considerable labor and care. Accordingly, automation of the grinding procedure has long been desired.

Grinding machines for automatic production of small flat specimens with controlled thickness are available commercially (e.g., Unipol PA-500, manufactured by Geos Corporation), but are relatively expensive, and generally do not provide the sometimes necessary option of grinding material from only one side of the specimen. Accordingly, the need for a relatively inexpensive and efficient means for producing substantially flat surface platelet specimens possessing uniform thickness still exists.

Another grinding apparatus identified as the 60-1908 AB Automet attachment and manufactured by Buchler, Ltd., has recently been used for fine grinding in metallography laboratories. In this apparatus, specimens in cylindrical mounts of standard diameter are clamped in a disk capable of holding several mounts. The mounted specimens are pressed against metallographic paper cemented on the flat, horizontal surface of a rotating grinding wheel. Adjustable spring pressure is applied at the center of the disk through a rotating shaft causing the disk to rotate during grinding providing equal average grinding conditions to all specimens. Initial efforts to utilize the 60-1908 AB Automet attachment for grinding platelets for electron transmission specimens did not produce platelets possessing the required flatness and uniform thickness. Accordingly, this device did not solve the problem of automatic production of platelet specimens possessing the flatness and uniform thickness required in electron-transmission microscopy. The present invention is directed to a new and improved grinding apparatus which automatically produces platelet specimens suitable for electron-transmission microscopy.

SUMMARY OF THE INVENTION

It is the primary object of the present invention to provide a new and improved grinding apparatus useful in the automatic production of specimen platelets possessing a substantially flat surface and substantially uniform thickness.

It is a further object of the present invention to provide a new and improved grinding apparatus useful in the automatic production of metal platelets possessing a substantially flat surface and substantially uniform thickness.

It is a still further object of the present invention to provide a new and improved grinding apparatus for the automatic production of specimen platelets possessing a substantially flat surface and a substantially uniform thicknesses suitable for electron-transmission microscopy.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing objects and in accordance with the present invention, as embodied and broadly described herein, the apparatus of the present invention may comprise a movable grinding surface attached to a frame, a specimen holder attached to the frame opposite to the grinding surface in a plane parallel to the grinding surface, the holder being capable of retaining at least one specimen, means attached to the frame for displacing the specimen holder toward the grinding surface, and at least three means attached to the frame and coupled to the specimen holder for limiting displacement of said holder toward the grinding surface by a predetermined distance.

In a preferred embodiment of the present invention the grinding surface is mounted to the frame in such a manner that it is capable of rotational movement.

In a further preferred embodiment of the present invention said means for limiting displacement are coupled to said holder in such a manner that said means can not contact said grinding surface.

In a still further preferred embodiment said displacing means comprises a shaft attached to the frame at a location above the specimen holder, the shaft being mounted in such a manner that it is free to move along its vertical axis to contact the specimen holder thereby exerting pressure on the holder during grinding.

Reference will now be made in detail to the preferred embodiment of the present invention.

DETAILED DESCRIPTION OF THE INVENTION

The apparatus of the present invention comprises a movable grinding surface attached to a frame, a specimen holder attached to the frame opposite the grinding surface in a plane parallel to the surface, the holder being capable of retaining at least one specimen, means attached to the frame for displacing the specimen holder toward the grinding surface and at least three means attached to the frame coupled to the specimen holder for limiting displacement of said holder toward the grinding surface by a predetermined distance.

In particular, the grinding surface is mounted onto the frame in such a manner that the grinding surface is capable of rotational movement. The specimen holder may comprise a stainless steel cylindrical disk possessing parallel faces which contain multiple cylindrical holes equidistant from the center and equally spaced about the circumference of the disk. The specimens are positioned in these holes during grinding. The specimen holder should preferably include a clamping means to hold the specimen in position.

In a further particular embodiment of the present invention the means for limiting displacement include fastening devices such as screws. These means for limiting displacement are coupled to the specimen holder in such a manner that the displacement limiting means cannot contact the grinding surface.

In a still further particular embodiment of the present invention the displacing means includes a shaft attached to the frame above the specimen holder. The shaft is capable of movement along its axis. Therefore, the shaft may be lowered into contact with the specimen holder to exert pressure on the holder during grinding.

Figure 1:
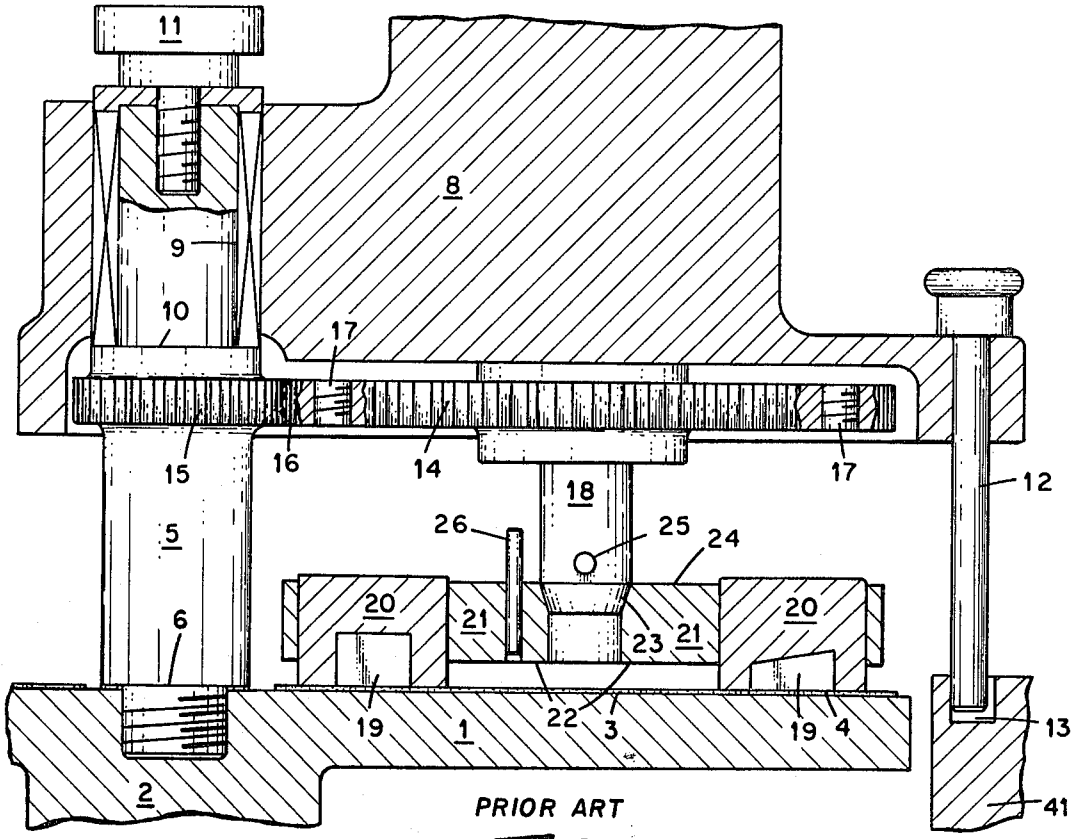
PRIOR ART Fig. 1
FIG. 1 is a cross section view illustrating the prior art grinding apparatus.

With reference to the drawings, FIG. 1 illustrates the prior art grinding apparatus. A circular grinding wheel 1 is attached to a driving mechanism (not shown) at hub 2. Grinding wheel 1 rotates about a vertical axis through the center of hub 2. Attached to the upper planar surface 3 of the grinding wheel 1 is a circular disk of metallographic polishing paper 4 possessing the desired coarseness. Polishing paper 4 may be attached to planar surface 3 by any suitably means such as chemical cement. In addition, paper 4 is chosen from conventional polishing disks containing a central hole. Accordingly, conventional polishing paper 4 contains a central hole enabling geared spindle 5 to be threaded into the center of grinding wheel 1 until the shoulders 6 at the bottom of spindle 5 rest firmly on the upper surface of grinding wheel 1. When the grinding apparatus is placed in this position, the axis of spindle 5 is aligned with the axis of rotation of grinding wheel 1 enabling spindle 5 to rotate with grinding wheel 1.

The head 8 is attached to spindle 5 by fitting a hollow cylindrical bearing 9 in head 8 over the upper portion of spindle 5 so that the bottom end of bearing 9 rests on shoulders 10 of spindle 5. Head 8 is clamped firmly to spindle 5 by screw clamp 11. Bearing 9 enables spindle 5 to rotate about its axis, while head 8 is prevented from rotating by a pin 12 which passes through head 8 into a recess 13 in work table 41. A gear wheel 14 is suspended from head 8. The teeth of gear wheel 14 mesh with the integral gear teeth 15 on spindle 5 at 16. Inside head 8 are bearings and supports (not shown) which enable gear wheel 14 to rotate about a central axis parallel to the axis of spindle 5, and hold gear wheel 14 at a fixed height above grinding wheel 1. Accordingly, rotation of grinding wheel 1 and spindle 5 causes rotation of gear wheel 14 in the opposite direction.

Gear wheel 14 contains two diametrically opposed threaded holes 17 and a cylindrical shaft 18 located in its center. Holes 17 are used in disassembling the apparatus. Shaft 18 is keyed to gear wheel 14 and rotates along with it. However, shaft 18 is mounted in such a manner that it is free to move vertically along the common axis. Mechanisms located within head 8 enable raising or lowering of shaft 18, and exertion of controlled downward pressure on shaft 18.

The grinding apparatus of FIG. 1 comes supplied with a number of specimen holding disks 21. Disks 21 includes a stainless steel cylinder having parallel planar faces possessing multiple cylindrical holes equidistant from the center of the disk and equally spaced about the circumference of the disk. There is also a clamping means (not shown) in each hole for holding each specimen. In an automatic grinding operation, each specimen 19 is mounted in cylindrical resin mounts 20 of diameter equal to that of the cylindrical holes, cylindrical resin mounts 20 containing specimens 19 are inserted in the holes of specimen-holding disk 21 and clamped by means (not shown) so that the faces of specimens 19 which are to be ground protrude beyond lower surface 22 of disk 21. The assembled disk is inserted in the grinding apparatus so that the surfaces to be ground rest on metallographic polishing paper 4 cemented to grinding wheel 1. Shaft 18 is lowered until truncated conical surface 23 on the end of shaft 18 fits into a similarly shaped recess at the center of upper surface 24 of specimen holding disk 21. Accordingly, disk 21 is centered on the axis of shaft 18. This centering operation may be facilitated by two aligning pins (not shown) which protrude vertically above upper surface 24 of disk 21. Grinding wheel 1 is started producing rotation of shaft 18 about its axis. This rotation causes horizontal pin 25 located at the lower end of shaft 18 to come in contact with a vertical pin 26 extending from the upper surface 24 of specimen disk 21. This contact produces rotation of specimen disk 21 containing the mounted specimens 19 about the axis of shaft 18. Any desired grinding pressure is applied to shaft 18 and transmitted through specimen holder disk 21 to cylindrical mounts 20 and specimens 19. Grinding is allowed to proceed with periodic inspection until the specimens 19 have attained the desired degree of flatness and thickness. Accordingly, it can be seen that the operation controls the time and pressure of grinding but there is no automatic control of grinding depth or final specimen thickness.

Figure 2:
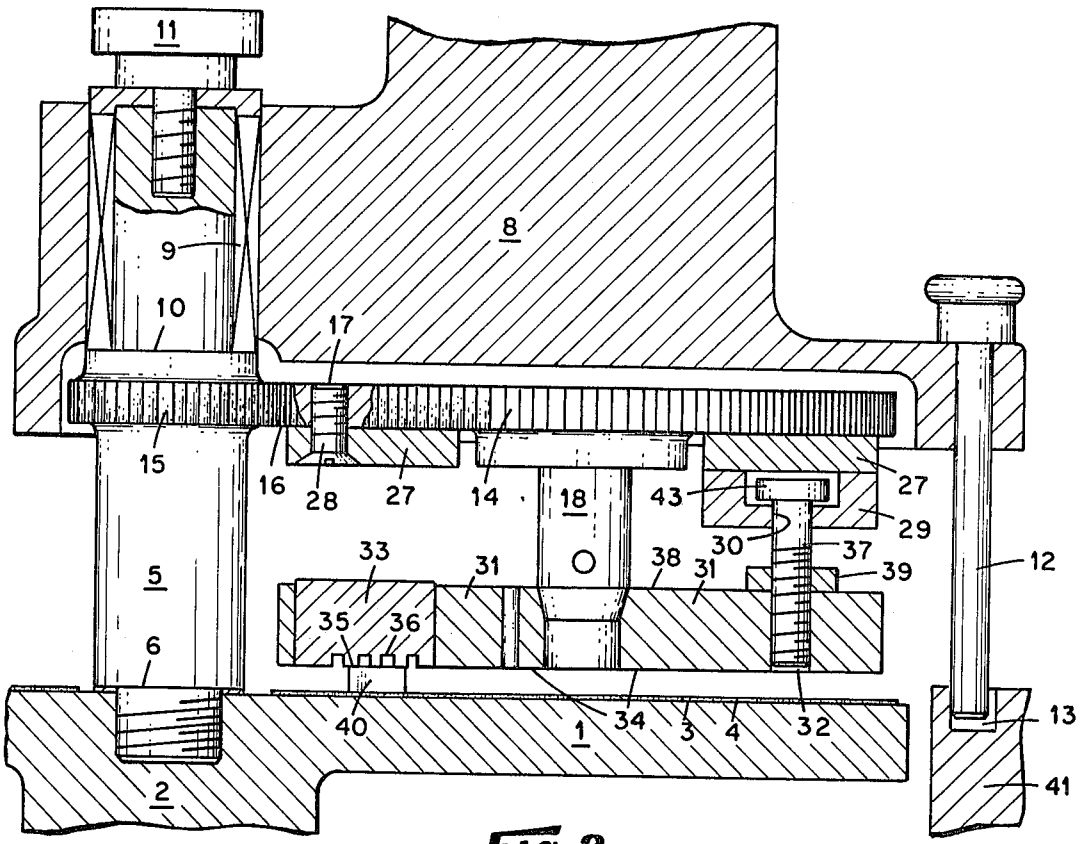
FIG. 2 is a cross section view illustrating the preferred embodiment of the new and improved grinding apparatus of the present invention.

With reference to FIG. 2 the improved grinding apparatus of the present invention is now described. The features and functions of the parts labeled 1 through 18 in FIG. 2 remain essentially the same as described previously in the apparatus shown in FIG. 1.

With reference to FIG. 2 the prior art grinding apparatus is modified to provide an automatic means of grinding specimens to a predetermined thickness and flatness. In FIG. 2, a brass ring 27 is firmly attached to the underside of gear wheel 14 by means of two screws 28 which fit through appropriately placed holes in ring 27 into the two existing threaded holes 17 in gear wheel 14. Only one screw 28 is shown in FIG. 2 to simplify the sketch. Ring 27 must have an outside diameter which is smaller than that of the roots of the gear teeth of gear wheel 14 to avoid interference with meshing between these teeth and gear teeth 15 of spindle 5. The inside diameter of ring 27 must be larger than the outside diameter of the hub of gear wheel 14. Attached to ring 27 at locations 120° apart, and suspended from its underside are three U-shaped support brackets 29. Only one of these three brackets 29 is shown in FIG. 2. Bracket 29 contains a slot 30 shaped to accept the shank of a $\frac{1}{4}\times 20$ hex-head bolt. Slot 30 extends partly through the cross-piece of bracket 29 and opens in the direction of rotation of gear wheel 14. A space 42 is provided between the horizontal cross-piece of bracket 29 and ring 27 to accept the head of the $\frac{1}{4}\times 20$ hex-head bolt. Space 42 has additional vertical clearance to enable vertical motion of the bolt head in space 42.

Specimen holder 31 is modified in accordance with the present invention in the following manner. Drive pin 26 (shown in FIG. 1) and the two alignment pins are removed from disk 31 to facilitate subsequent operations. Three vertical holes 32 (only one shown) are drilled through disk 31 and tapped with $\frac{1}{4}\times 20$ threads. Holes 32 are spaced 120° apart at a radial distance from the center of the disk equal to the radial distance from the centers of slots 30 in bracket 29 to the axis of rotation of gear wheel 14. Six metal cylinders 33 (only two shown) are inserted into their respective specimen holes of disk 31. Cylinders 33 are clamped in disk 31 so that cylinders 33 extend beyond the lower surface 34 of disk 31. Lands 35 and grooves 36 are present in each protruding face of cylinders 33. After the cylinders have been clamped in place, lands 35 are ground or machined to a common plane parallel to the plane of lower surface 34 of disk 31 which is at a distance from the protruding face of cylinder 33 which is less than the desired final thickness of the specimens to be ground. It should be appreciated that lands 35 or any suitable planar specimen support surfaces for each of the cylinders 33 may be ground to different heights enabling simultaneous grinding of specimens to at least two different thicknesses. In this case, identifying numbers should be clamped on the undersurface of disk 34 near each cylinder 33 to facilitate identification for each separate recess depth. Hex-head $\frac{1}{4}\times 20$ support bolts 37 are screwed into holes 32 so that bolt heads 43 extend beyond upper surface 38 of disk 31. While FIG. 2 for the sake of simplicity shows only one bolt 37 and hole 32, it must be understood that at least three holes 32 and bolts 37 are required. The modified disk 31 is assembled to head 8 by inserting support bolts 37 in the openings or slots 30 in the three support brackets 29. The heights of bolt heads 43 above upper surface 38 are adjusted so that, when the bottom shoulders of all three bolt heads 43 are resting on and supported by the horizontal cross pieces of the support brackets 29, the plane or planes of land surfaces 35 are parallel to the plane of planar grinding wheel surface 3 at a distance above the planar grinding surface of paper 4 equal to the final desired specimen thickness(es). Although it is not necessary, it may be desirable to provide lock nuts 39 on bolts 37. Lock nuts 39 function to prevent accidental displacement of the bolt heights by tightening against upper surface 38 of disk 31.

During a typical grinding operation modified specimen holding disk 31 is disengaged from head 8 and inverted. Specimen(s) 40 is placed firmly against the surface of lands 35, and cemented in the recesses of cylinder faces 33. Grooves 36 facilitate the cementing. Disk 31 with attached specimen(s) 40 is reengaged with head 8 by inserting bolts 37 within slots 30 of support brackets 29. Specimen(s) 40 is now in contact with polishing paper 4. At this time, the bottom shoulders of bolt heads 43 extend above the upper surface of the horizontal cross-pieces of support brackets 29 to a height approximately equal to the maximum excess initial specimen thickness(es). Shaft 18 is lowered to contact the center of disk 31 exerting the desired grinding pressure on disk 31 which transmits the pressure to specimen(s) 40. Grinding wheel 1 is started commencing rotation. The resulting rotation of gear wheel 14 causes the horizontal cross-pieces of support brackets 29 to exert circumferential pressure against the shanks of bolts 37 producing rotation of disk 31 about the common axis of disk 31, shaft 18, and gear wheel 14. This rotational movement evenly distributes wear over the grinding surface of paper 4 during grinding to reduce the specimen thickness. As the grinding proceeds the support bolt heads 43 descend until all three bolts heads 43 rest on the upper surface of the support brackets 29. At this time the land surfaces 35 are at the preadjusted position, and the specimens have accordingly attained the desired thickness and flatness. Since disk 31 cannot move any further toward the planar grinding surface of paper 4, additional grinding cannot take place. Therefore, despite continued rotation of grinding wheel 1 no additional grinding is possible. The pressure exerted by shaft 18 against disk 31 can no longer force specimen(s) 40 against the grinding paper 4 and becomes transmitted instead through support bolts 37 and brackets 29 to the support bearings of gear wheel 14 within the housing of head 8. When grinding has been completed, shaft 18 is retracted, disk 31 with attached specimens 40 is disengaged from head 8 and inverted. Specimens 40 are then removed by dissolving the cement in any suitable solvent. Grooves 36 facilitate dissolution of the cement.

Specimens which initially have one satisfactory flat surface may be ground to the desired final thickness in one operation by mounting the flat surface against lands 35 in a recess of appropriate depth. Other specimens must be ground first to produce the flat surface necessary for grinding to the desired final uniform thickness.

As is readily apparent from the above described operation of the new and improved grinding apparatus of the present invention, the grinding of the specimen automatically stops at the desired uniform thickness and flatness established by the adjustment made in the height of support bolts 37. Accordingly, there is no need for constant inspection by an operator to determine if the required thickness has been obtained. The final ground condition can readily be detected either by (1) the decreased intensity of the sound of grinding, or (2) the absence of resistance to rotation of head 8 about spindle 5 when rotation of grinding wheel 1 is terminated and pin 12 is disengaged from recess 13.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A grinding apparatus for producing substantially flat platelet specimens possessing a substantially uniform thickness comprising:

a. a movable grinding surface attached to a frame, b. a specimen holder attached to said frame opposite said grinding surface in a plane parallel to said grinding surface, said holder including a stainless steel cylindrical disk having parallel faces which contain multiple cylindrical holes equidistant from the center of said disk and equally spaced about the circumference of said disk, said multiple cylindrical holes containing planar specimen support surfaces at different depths thereby enabling simultaneous grinding of specimens to different uniform thicknesses, c. means attached to said frame for displacing said holder toward said grinding surface, and d. at least three means coupled to said holder for limiting displacement of said holder toward said grinding surface by a predetermined distance.

2. A grinding apparatus according to claim 1 wherein said grinding surface is attached to the frame in such a manner that said surface is capable of rotation.

3. A grinding apparatus according to claim 1 wherein said means for limiting displacement include fastening devices.

4. A grinding apparatus according to claim 1 wherein said means for limiting displacement are coupled to said holder in such a manner that said means do not contact said grinding surface.

5. A grinding apparatus according to claim 1 wherein said displacing means comprises a shaft attached to the frame above the specimen holder, said shaft being mounted in such a manner that it is free to move along its vertical axis.

* * * * *